US007812552B2

(12) United States Patent
Yang

(10) Patent No.: US 7,812,552 B2
(45) Date of Patent: Oct. 12, 2010

(54) CONTROLLER OF LED LIGHTING TO CONTROL THE MAXIMUM VOLTAGE OF LEDS AND THE MAXIMUM VOLTAGE ACROSS CURRENT SOURCES

(75) Inventor: Ta-Yung Yang, Milpitas, CA (US)

(73) Assignee: System General Corp., Taipei (TW)

( * ) Notice: Subject to any disclaimer, the term of this patent is extended or adjusted under 35 U.S.C. 154(b) by 373 days.

(21) Appl. No.: 12/026,339

(22) Filed: Feb. 5, 2008

(65) Prior Publication Data

US 2009/0195183 A1 Aug. 6, 2009

(51) Int. Cl.
*H05B 37/02* (2006.01)

(52) U.S. Cl. ..... 315/294; 315/297; 315/307

(58) Field of Classification Search ..... 315/219, 315/225, 247, 276, 294, 297, 307; 363/21.12, 363/21.15–21.18
See application file for complete search history.

(56) References Cited

U.S. PATENT DOCUMENTS 7,443,209 B2 * 10/2008 Chang ..... 327/94
7,550,933 B1 * 6/2009 Yang ..... 315/308
7,642,729 B2 * 1/2010 Saitoh et al. ..... 315/291
2006/0028148 A1 * 2/2006 Ichikawa et al. ..... 315/219
2007/0273681 A1 * 11/2007 Mayell ..... 345/211
2008/0136350 A1 * 6/2008 Tripathi et al. ..... 315/294
2008/0192514 A1 * 8/2008 Zhou et al. ..... 363/21.12

* cited by examiner

*Primary Examiner*—Douglas W Owens
*Assistant Examiner*—Tung X Le
(74) *Attorney, Agent, or Firm*—Banger Shia

(57) ABSTRACT

Controller of LED lighting to control the maximum voltage of LEDs and the maximum voltage across current sources is provided. A voltage-feedback circuit is coupled to the LEDs to sense a voltage-feedback signal for generating a voltage loop signal. Current sources are coupled to the LEDs to control the LED currents. A detection circuit senses the voltages of the current sources for generating a clamp signal in response to a maximum voltage of the current sources. Furthermore, a buffer circuit generates a feedback signal in accordance with the voltage loop signal and the clamp signal. The feedback signal controls the maximum voltage of the LEDs and the maximum voltage across the current sources.

12 Claims, 11 Drawing Sheets

CONTROLLER OF LED LIGHTING TO CONTROL THE MAXIMUM VOLTAGE OF LEDS AND THE MAXIMUM VOLTAGE ACROSS CURRENT SOURCES

BACKGROUND OF THE INVENTION

1. Field of the Invention

The present invention relates to a LED (light emission diode) driver, and more particularly to a controller to control the maximum voltage of the LEDs and the maximum voltage across current sources.

2. Description of Related Art

The LED driver is utilized to control the brightness of the LED in accordance with its characteristic. The LED driver is also utilized to control the current that flow through the LED. A higher current increases intensity of the bright of the LED, but decreases the life of the LED. FIG. 1 shows a traditional offline circuit of the LED driver. The output voltage $V_O$ of the LED driver is adjusted to provide a current $I_{LED}$ through a resistor 79 to LEDs 71 to 75. The current $I_{LED}$ is shown as, $$I_{LED} = \frac{V_O - V_{F71} - \ldots - V_{F75}}{R_{79}} \quad (1)$$

wherein the $V_{F71}$ to $V_{F75}$ are the forward voltage of the LEDs 71 to 75 respectively.

The drawback of the LED driver shown in FIG. 1 is the variation of the current $I_{LED}$. The current $I_{LED}$ is changed in response to the change of the forward voltage of $V_{F71}$ to $V_{F75}$. The forward voltages of $V_{F71}$ to $V_{F75}$ are not the constant due to the variation of the production and operating temperature. Hence, the maximum voltage and the maximum current of the LEDs 71 to 75, 81 to 85 may overload and decrease the life of the LEDs 71 to 75, 81 to 85.

SUMMARY OF THE INVENTION

An objective of the invention is to provide an offline control circuit and a controller to control the maximum voltage of the LEDs and the maximum voltage across current sources.

The present invention provides a controller of LED driver. The controller includes a voltage-feedback circuit, a plurality of current sources, a detection circuit and a buffer circuit. The voltage-feedback circuit is coupled to a plurality of LEDs to sense a voltage-feedback signal for generating a voltage loop signal. The current sources are coupled to the LEDs to control the LED currents. The detection circuit senses the voltages of current sources for generating a clamp signal in response to a maximum voltage of the current sources. The buffer circuit generates a feedback signal in accordance with the voltage loop signal and the clamp signal. The voltage-feedback signal is correlated to the voltage across the LEDs. The feedback signal is coupled to control the maximum voltage of the LEDs and the maximum voltage across the current sources.

Furthermore, the present invention provides an offline control circuit of LED driver. The offline control circuit includes a voltage-feedback circuit, a plurality of current sources, a detection circuit and a buffer circuit. A plurality of LEDs are connected in series and parallel. The voltage-feedback circuit is coupled to the LEDs to sense a voltage-feedback signal for generating a voltage loop signal. The current sources are coupled to the LEDs to control the LED currents. The detection circuit senses the voltages of the current sources for generating a clamp signal in response to a maximum voltage of the current sources. The buffer circuit generates a feedback signal in accordance with the voltage loop signal and the clamp signal. The voltage-feedback signal is correlated to the voltage across the LEDs. The feedback signal is coupled to control a maximum voltage of the LEDs and a maximum voltage across the current sources.

BRIEF DESCRIPTION OF THE DRAWINGS

The accompanying drawings are included to provide a further understanding of the present invention, and are incorporated in and constitute a part of this specification. The drawings illustrate embodiments of the present invention and, together with the description, serve to explain the principles of the present invention. In the drawings.

DESCRIPTION OF THE PREFERRED EMBODIMENTS

Figure 1:
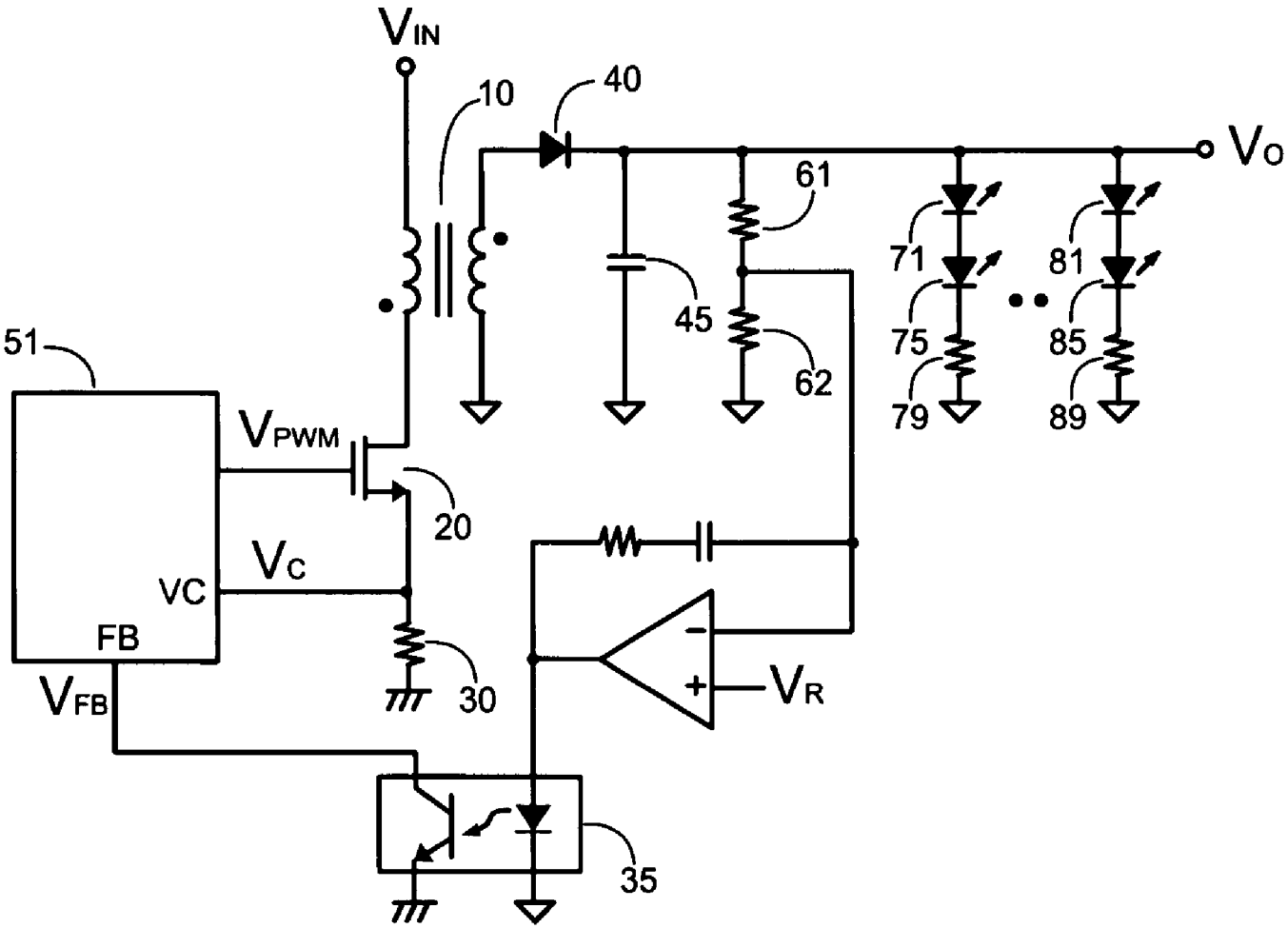
FIG. 1 (PRIOR ART)
FIG. 1 shows a circuit diagram of a conventional offline LED driver.
Figure 2:
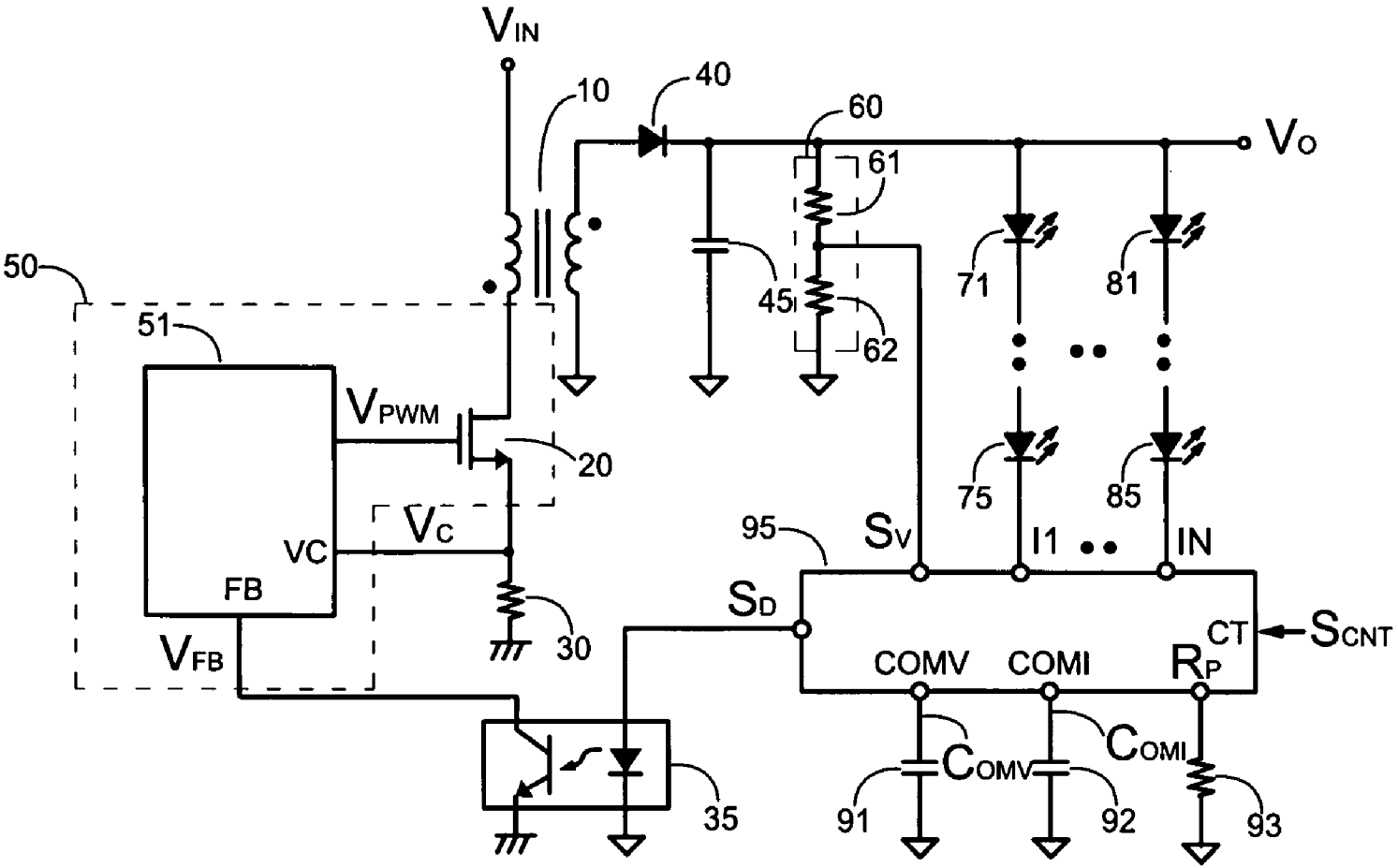
FIG. 2 shows a circuit diagram of an offline control circuit of a LED driver in accordance with present invention.

FIG. 2 shows a preferred embodiment of an offline control circuit of a LED driver in accordance with present invention. The offline control circuit includes a switching circuit 50, a voltage divider 60, a first capacitor 91, a second capacitor 92 and a controller 95. LEDs 81 to 85 is connected with the LEDs 71 to 75 in parallel, and LEDs 71 to 75 and 81 to 85 are connected to the controller 95. An output voltage $V_O$ is supplied to the LEDs 71 to 75 and 81 to 85 through the controller 95. A plurality of LED currents flow into a plurality of current sources I1 to IN of the controller 95. The voltage divider 60 has at least two resistors 61 and 62 and detects the output voltage $V_O$ to generate a voltage-feedback signal $S_V$. The controller 95 detects the voltage of the current sources I1 to IN and receives the voltage-feedback signal $S_V$. A control terminal CT of the controller 95 receives a control signal $S_{CNT}$ for controlling the on/off of the current sources I1 to IN and the intensity of the LEDs.

The switching circuit 50 including a switching controller 51 and a power transistor 20 generates the LED currents through a transformer 10. A rectifier 40 and a capacitor 45 couple to the transformer 10 and produce the output voltage $V_O$ in response to the switching of the transformer 10. The switching controller 51 generates a switching signal $V_{PWM}$ in accordance with a feedback voltage $V_{FB}$ and a switching current signal $V_C$. The feedback voltage $V_{FB}$ is produced by the feedback signal $S_D$ through an optical coupler 35. The switching signal $V_{PWM}$ is coupled to switch the transformer 10 through the power transistor 20. The pulse width of the switching signal $V_{PWM}$ determines the amplitude of the output voltage $V_O$. A resistor 30 is connected to the power transistor 20 and coupled to the transformer 10. The resistor 30 detects the switching current of the transformer 10 for generating the switching current signal $V_C$.

Figure 3:
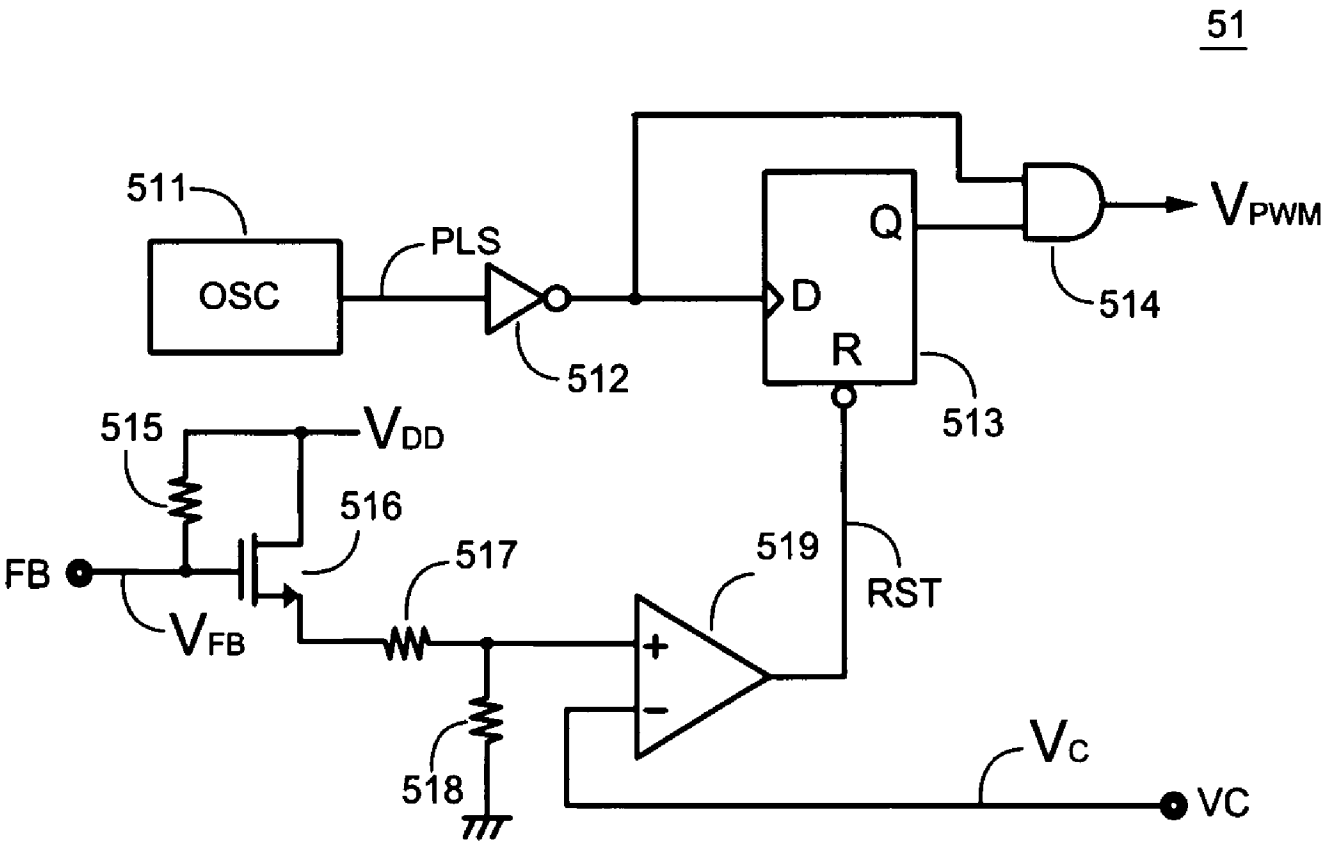
FIG. 3 shows a circuit diagram of a switching controller according to the present invention.

FIG. 3 shows the circuit diagram of the switching controller 51 according to the present invention. The switching controller 51 includes an oscillator (OSC) 511, an inverter 512, a flip-flop 513, an AND gate 514, a comparator 519, a pull high resistor 515, a level-shift transistor 516 and two resistors 517, 518. The oscillator (OSC) 511 generates a pulse signal PLS coupled to the flip-flop 513 via the inverter 512 and enables the flip-flop 53. An output Q of the flip-flop 513 and the output of the inverter 512 are connected to the AND gate 514 to enable the switching signal $V_{PWM}$. The feedback voltage $V_{FB}$ is transmitted to the level-shift transistor 516. The pull high resistor 515 is connected to the level-shift transistor 516 for the bias. The resistors 517 and 518 form a voltage divider and are connected to the level-shift transistor 516 for generating an attenuation signal. The attenuation signal is transmitted to an input of the comparator 519. Another input of the comparator 519 receives the switching current signal $V_C$. The comparator 519 compares the attenuation signal with the switching current signal $V_C$ and generates a reset signal RST to disable the switching signal $V_{PWM}$ through the flip-flop 513.

Figure 4:
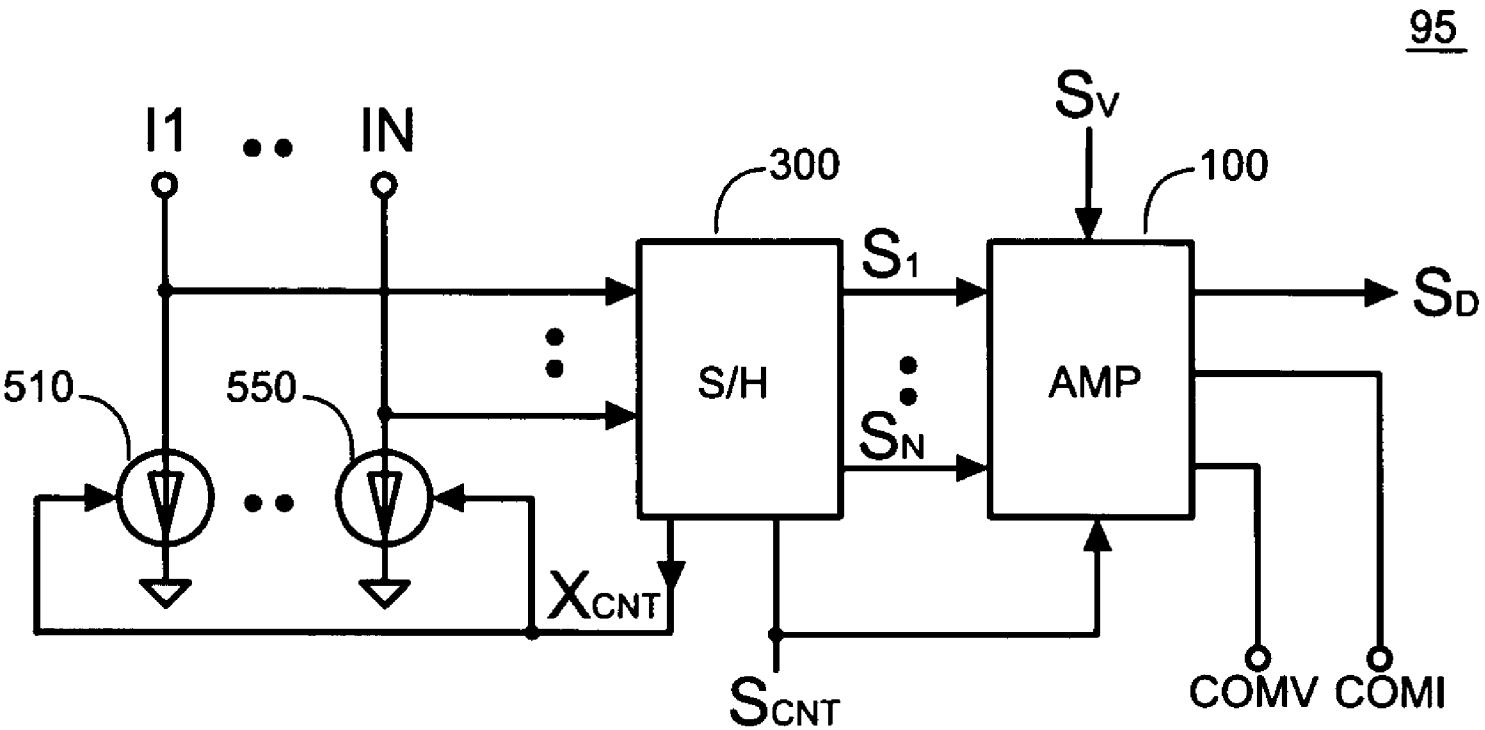
FIG. 4 is a circuit diagram of the controller of the LED driver in accordance with the present invention.

FIG. 4 is the circuit schematic of the controller 95 in accordance with present invention. A plurality of current-source elements 510 to 550 are applied to form the current sources I1 to IN. The current sources I1 to IN are coupled to the LEDs to control the LED currents. A control signal $X_{CNT}$ is coupled to control the on/off of the current-source elements 510 to 550. The control signal $X_{CNT}$ is generated by the control signal $S_{CNT}$ through a sample-and-hold circuit (S/H) 300. The sample-and-hold circuit 300 senses the voltages of the current sources I1 to IN for generating a plurality of current-source signals $S_1$ to $S_N$. A voltage-feedback circuit of a feedback circuit (AMP) 100 senses the voltage-feedback signal $S_V$ to generate a voltage loop signal $C_{OMV}$. A buffer circuit of the feedback circuit 100 generates the feedback signal $S_D$ in accordance with the voltage loop signal $C_{OMV}$ and the clamp signal $C_{OMI}$. The feedback signal $S_D$ controls the maximum voltage of the LEDs and the maximum voltage across the current sources I1 to IN.

Figure 5:
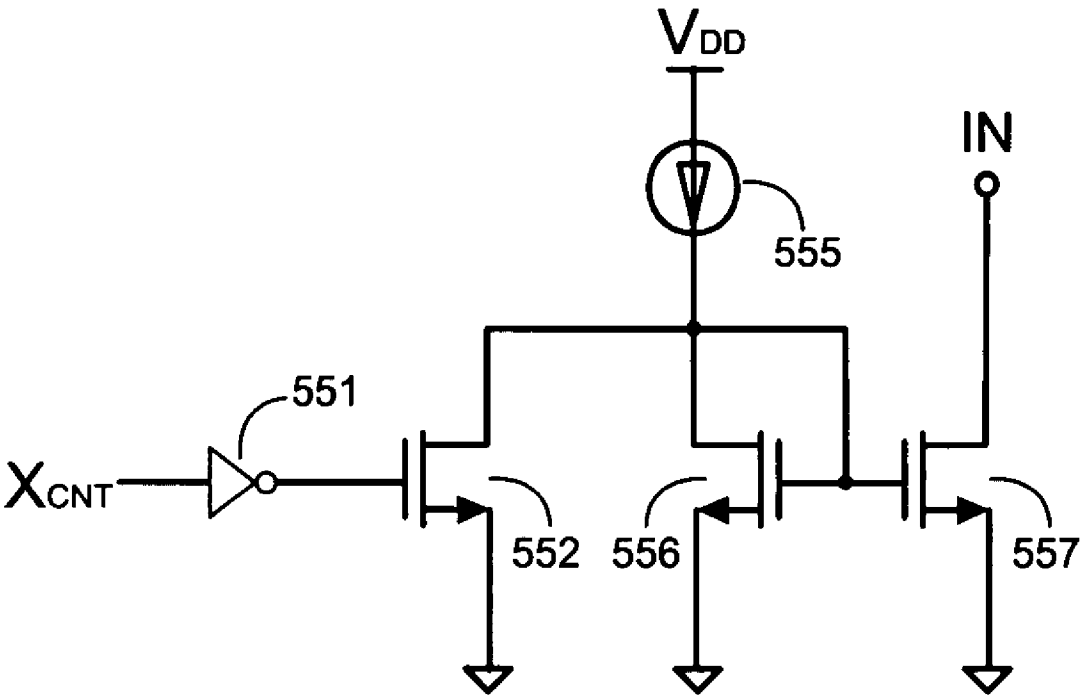
FIG. 5 shows the circuit diagram of the current-source element in accordance with present invention.

FIG. 5 shows the circuit diagram of the current-source element 550 in accordance with present invention. The current-source element 550 includes a current source 555, transistors 552, 556 and 557, and an inverter 551. The current source 555 is connected to the transistors 552, 556 and 557. The transistors 556 and 557 form a current mirror to generate the current source IN at the transistor 557. The control signal $X_{CNT}$ is transmitted to the transistor 552 through the inverter 551 to control the on/off of the transistor 557 and the current source IN.

Figure 6:
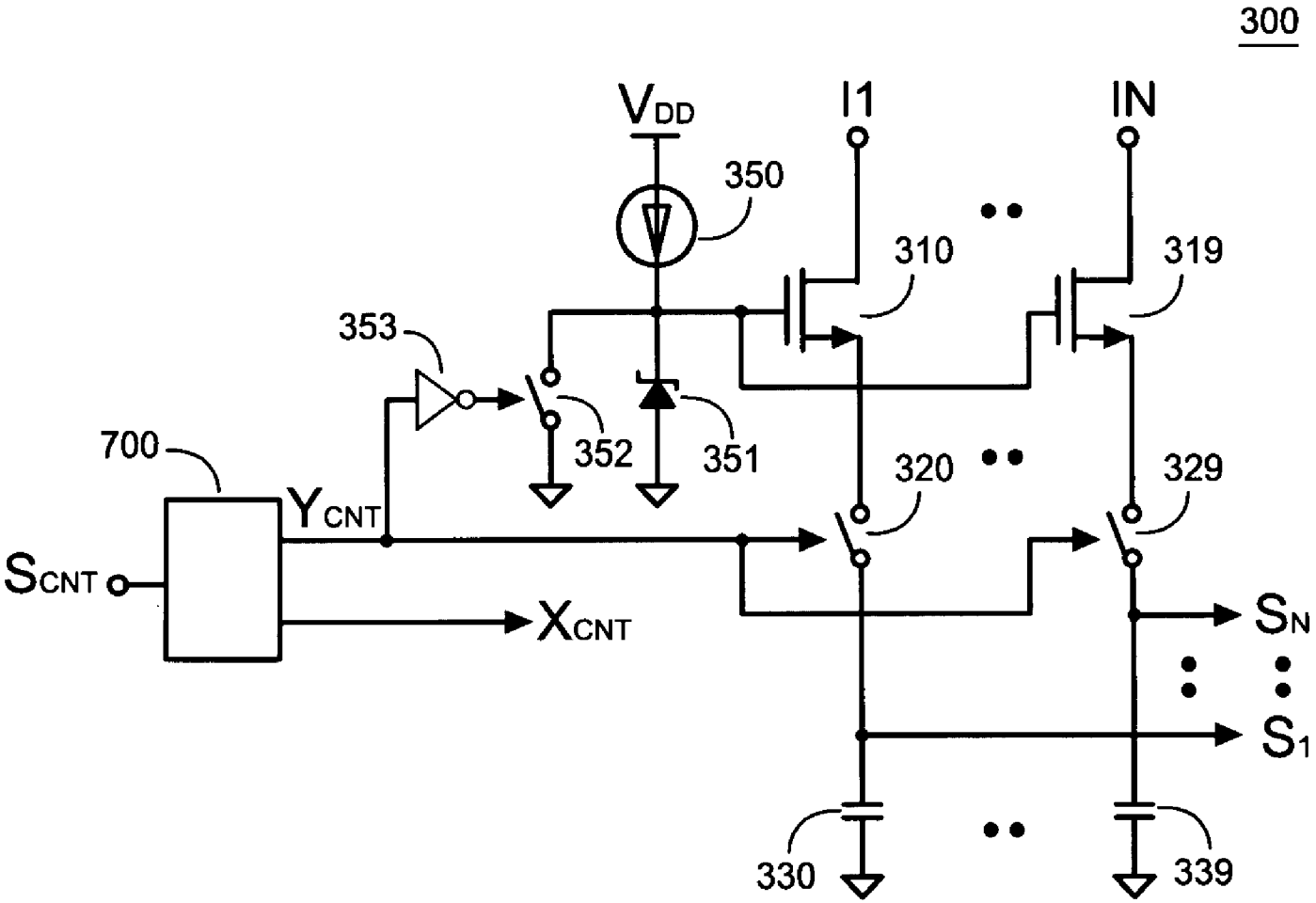
FIG. 6 shows the circuit schematic of the sample-and-hold circuit in accordance with present invention.

FIG. 6 shows the circuit schematic of the sample-and-hold circuit 300 in accordance with present invention. The sample-and-hold circuit 300 includes a plurality of voltage-clamp transistors 310 to 319, a plurality of sample-switches 320 to 329, a plurality of hold-capacitors 330 to 339, a current source 350, a zener diode 351, a switch 352, an inverter 353 and a signal generation circuit 700. The voltage-clamp transistors 310 to 319 are coupled to the current sources I1 to IN for clamping the voltage of the current sources I1 to IN under a maximum value. Each of the voltage-clamp transistors 310 to 319 has a source terminal, coupled to the sample-switches 320 to 329 in series respectively for sampling the voltage of the current sources I1 to IN. The hold-capacitors 330 to 339 are coupled to the sample-switches 320 to 329 for generating the current-source signals $S_1$ to $S_N$. The signal generation circuit 700 generates a control signal $Y_{CNT}$ and the control signal $X_{CNT}$ in response to the control signal $S_{CNT}$. The control signal $Y_{CNT}$ controls the sample-switches 320 to 329. A threshold voltage $V_T$ generated by the zener diode 351 is transmitted to the gate of the voltage-clamp transistors 310 to 319. The current source 350 provides a bias to the zener diode 351. The switch 352 is connected from the gate of voltage-clamp transistors 310 to 319 to the ground. The switch 352 is controlled by the control signal $Y_{CNT}$ through the inverter 353. Therefore, the voltage-clamp transistors 310 to 319 would be turned off in response to the control signal $Y_{CNT}$.

Figure 7:
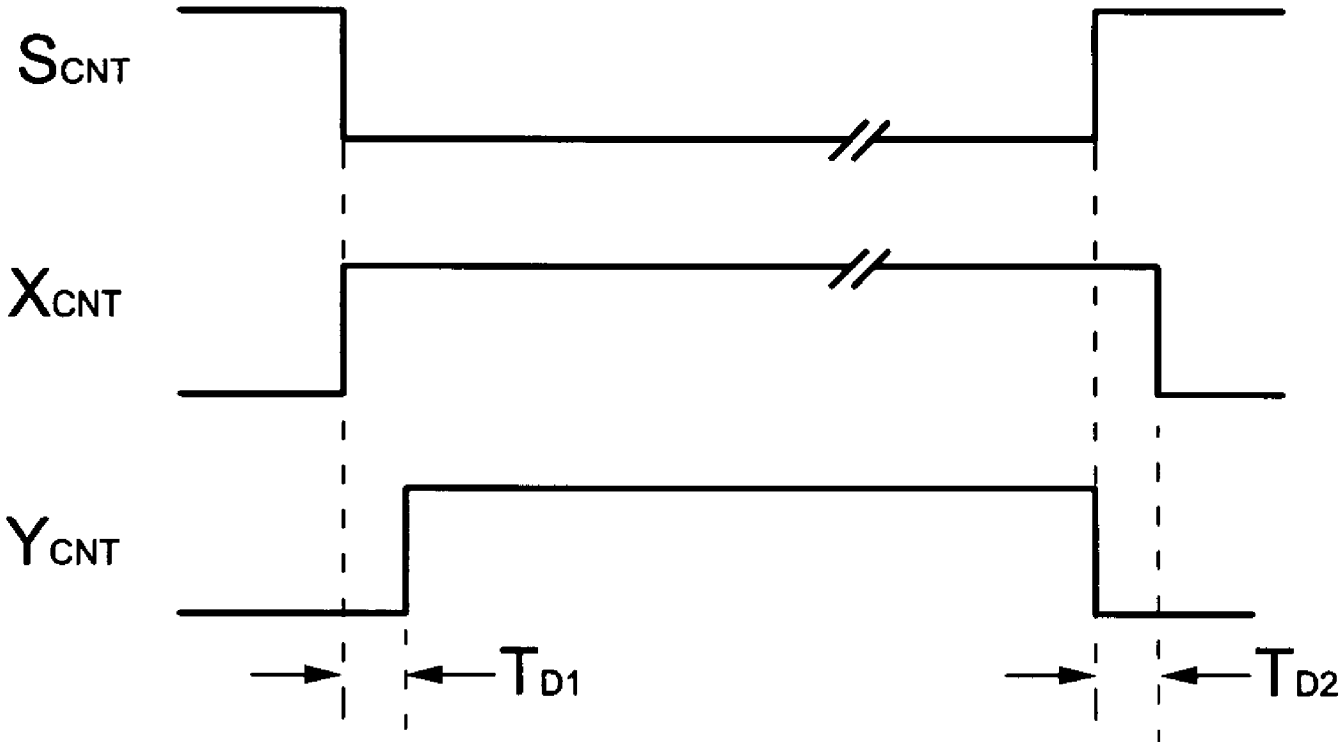
FIG. 7 shows signal waveforms of the sample-and-hold circuit according to the present invention.
Figure 8:
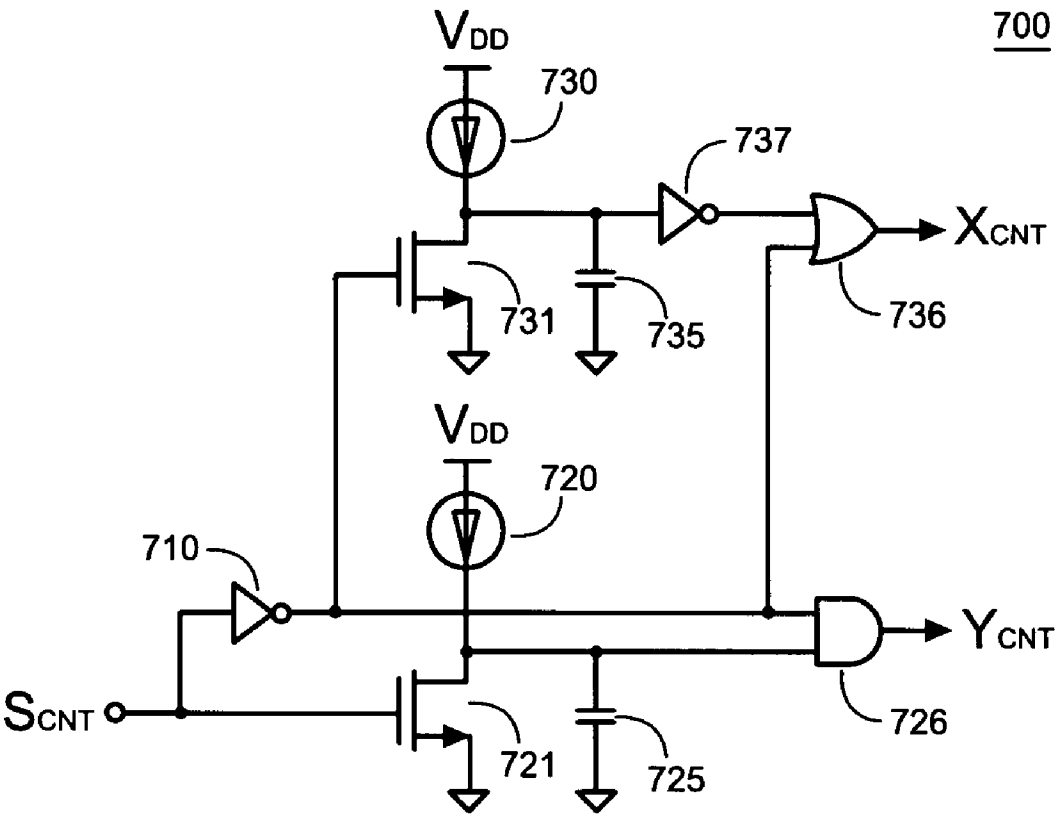
FIG. 8 shows a circuit diagram of a preferred embodiment of the signal generation circuit according to the present invention.

FIG. 7 shows signal waveforms of the sample-and-hold circuit 300. Delay times $T_{D1}$ and $T_{D2}$ are inserted between the control signals $S_{CNT}$, $X_{CNT}$ and $Y_{CNT}$. FIG. 8 shows a circuit diagram of a preferred embodiment of the signal generation circuit 700 in accordance with present invention. The signal generation circuit 700 includes two current sources 720, 730, two transistors 721, 731, two capacitors 725, 735, two inverters 710, 737, an OR gate 736 and an AND gate 726. The current source 720 and the capacitance of the capacitor 725 determine the delay time $T_{D1}$. The current source 730 and the capacitance of the capacitor 735 determine the delay time $T_{D2}$. The control signal $S_{CNT}$ controls the transistor 721. The transistor 721 is coupled to the capacitor 725 and discharges the capacitor 725. The control signal $S_{CNT}$ is further controls the transistor 731 through the inverter 710. The transistor 731 is coupled to the capacitor 735 and discharges the capacitor 735. The OR gate 736 generates the control signal $X_{CNT}$. The input of OR gate 736 is connected to the capacitor 735 via the inverter 737, and another input of OR gate 736 is connected to the output of the inverter 710. The AND gate 726 generates the control signal $Y_{CNT}$. The input of the AND gate 726 is connected to the capacitor 725, and another input of the AND gate 726 is connected to the output of the inverter 710.

Figure 9:
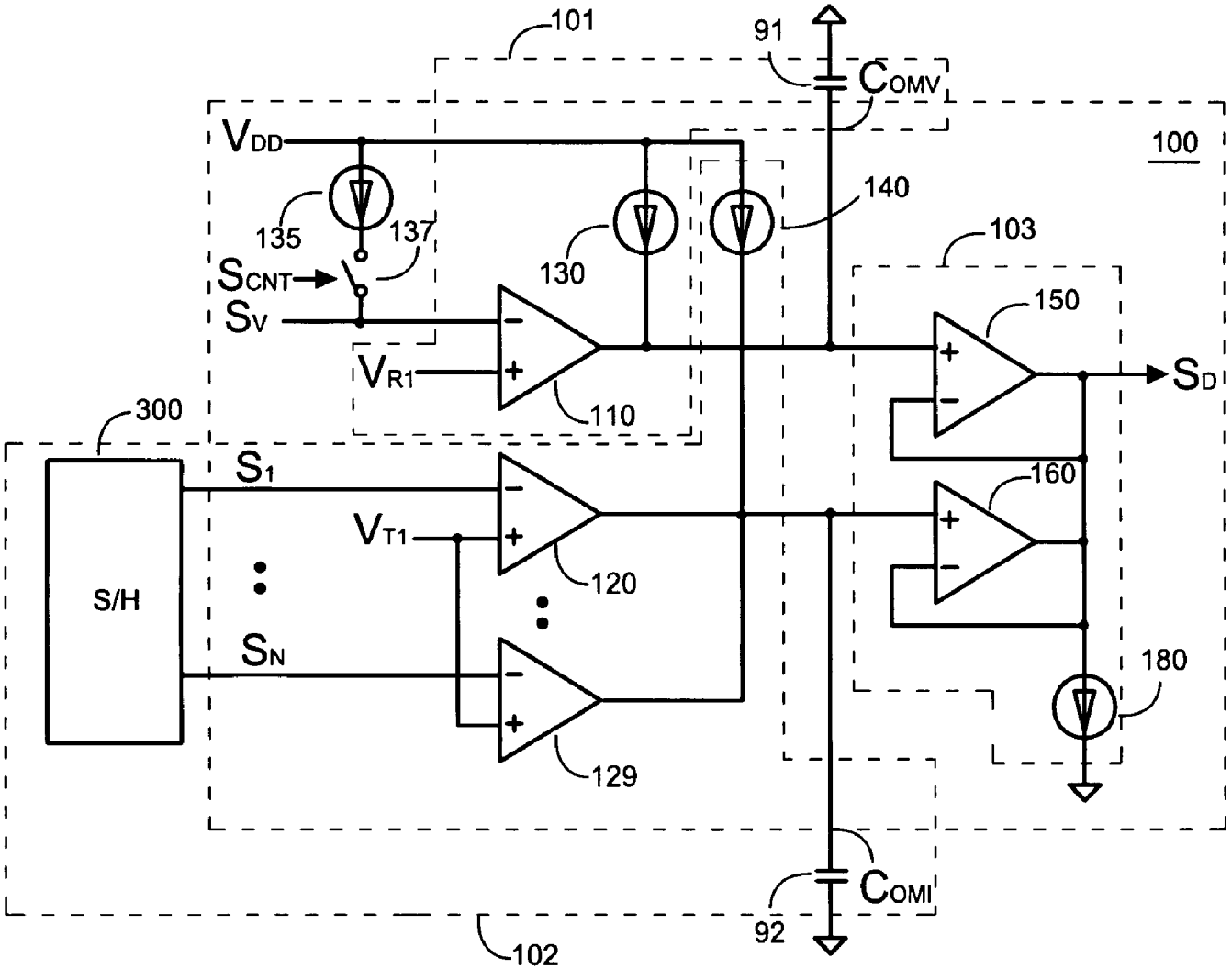
FIG. 9 shows a circuit diagram of the feedback circuit in accordance with present invention.

FIG. 9 shows a circuit diagram of the feedback circuit 100 in accordance with present invention. The feedback circuit 100 includes a voltage-feedback circuit 101, a detection circuit 102, a buffer circuit 103, a current source 135 and a switch 137. The voltage-feedback circuit 101 includes an operational amplifier 110, a current source 130 and the first capacitor 91 (as also shown in FIG. 2). The operational amplifier 110 has a reference voltage $V_{R1}$ comparing with the voltage-feedback signal $S_V$ to generate the voltage loop signal $C_{OMV}$. The first capacitor 91 is coupled from the output of the operational amplifier 110 to the ground for frequency compensation. The operational amplifier 110 is a trans-conductance operational amplifier.

The detection circuit 102 includes the sample-and-hold circuit 300, a plurality of amplifiers 120 to 129, a current source 140 and the second capacitor 92 (as also shown in FIG. 2). The positive input of amplifiers 120 to 129 has a current threshold $V_{T1}$. The negative input of amplifiers 120 to 129 sense the current-feedback signals $S_1$ to $S_N$ respectively. The amplifiers 120 to 129 generate the clamp signal $C_{OMI}$ in response the maximum voltage of current sources I1 to IN. The second capacitor 92 is coupled from outputs of the amplifiers 120 to 129 to the ground for frequency compensation. The amplifiers 120 to 129 are trans-conductance operational amplifier and parallel connected.

The buffer circuit 103 includes two buffer amplifiers 150, 160 and a current source 180 to generate a feedback signal $S_D$ in accordance with a voltage loop signal $C_{OMV}$ and a clamp signal $C_{OMI}$. The buffer amplifier 150 and the buffer amplifier 160 are connected in parallel. The feedback signal $S_D$ is coupled to the switching controller 51 through the optical-coupler 35 for controlling the maximum voltage and the maximum current of the LEDs.

A current source 135 is coupled to the voltage divider 60 (as shown in FIG. 2) through a switch 137 and receives the voltage-feedback signal $S_V$. The control signal $S_{CNT}$ controls the switch 137. Therefore, a control current is generated in response to the control signal $S_{CNT}$. The amplitude of the control current is determined by the current source 135. The control current is coupled to the voltage divider 60 to control the voltage across the LEDs.

$$V_O = \frac{R_{61} + R_{62}}{R_{62}} \times V_{R1} \tag{1}$$

$$V_O = \frac{R_{61} + R_{62}}{R_{62}} \times \left(V_{R1} - I_{135} \times \frac{R_{61} \times R_{62}}{R_{61} + R_{62}}\right) \tag{2}$$

Where $R_{61}$ and $R_{62}$ are the resistance of the resistors 61 and 62 respectively; and $I_{135}$ is the current of the current source 135.

Equation (1) shows the voltage across the LEDs when the switch 137 is off. Equation (2) shows the voltage across the LEDs once the switch 135 is on. The value of the LEDs voltage would be programmed by the ratio and the value of the resistance of the resistors 61 and 62.

Figure 10:
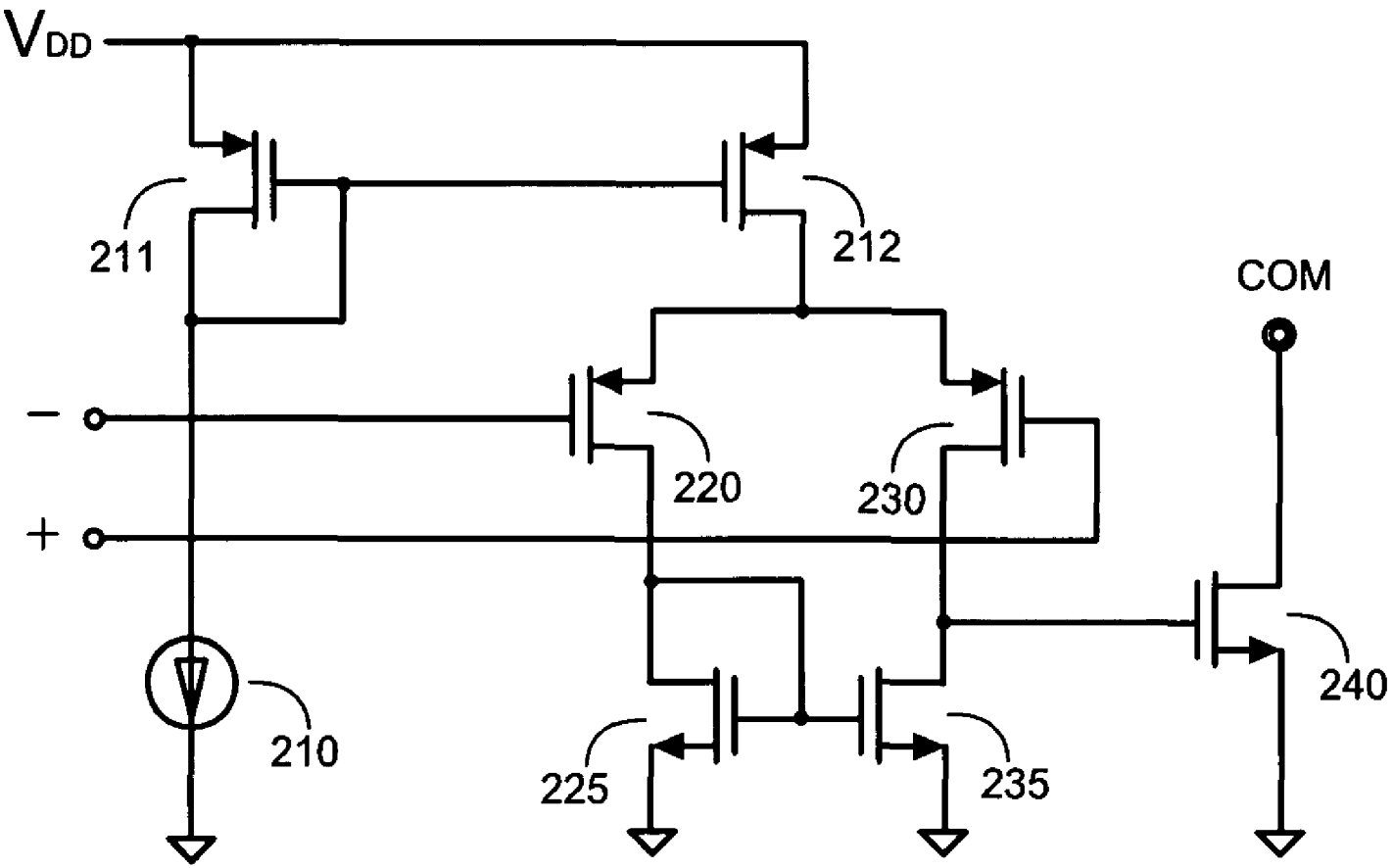
FIG. 10 shows a circuit diagram of a trans-conductance operational amplifier according to the present invention.

FIG. 10 shows an example circuit for the trans-conductance operational amplifiers 110, 120 to 129. The circuit comprises a plurality of transistors 211, 212, 220, 225, 230, 235, 240 and a current source 210. The transistor 211 has a gate that is coupled to the transistor 212 and the current source 210, a drain that is coupled to the current source 210, and a source that is coupled to a voltage source $V_{DD}$ and the transistor 212. The transistor 212 has a gate that is coupled to the transistor 211, a drain that is coupled to the transistors 220 and 230, and a source that is coupled to the voltage source $V_{DD}$ and the transistor 211. The transistor 220 has a gate that is coupled to an inverting input terminal of the amplifier, a drain that is coupled to the transistors 225 and 235, and a source that is coupled to the transistor 212. The transistor 230 has a gate that is coupled to a non-inverting input terminal of the amplifier, a drain that is coupled to the transistors 235 and 240, and a source that is coupled to the transistor 212. The transistor 225 has a gate that is coupled to the transistors 235 and 220, a drain that is coupled to the transistor 220, and a source that is coupled to the ground. The transistor 235 has a gate that is coupled to the transistors 225 and 220, a drain that is coupled to the transistor 240, and a source that is coupled to the ground. The transistor 240 has a gate that is coupled to the transistors 230 and 235, a drain that is coupled to a common terminal COM of the amplifier, and a source that is coupled to the ground.

Figure 11:
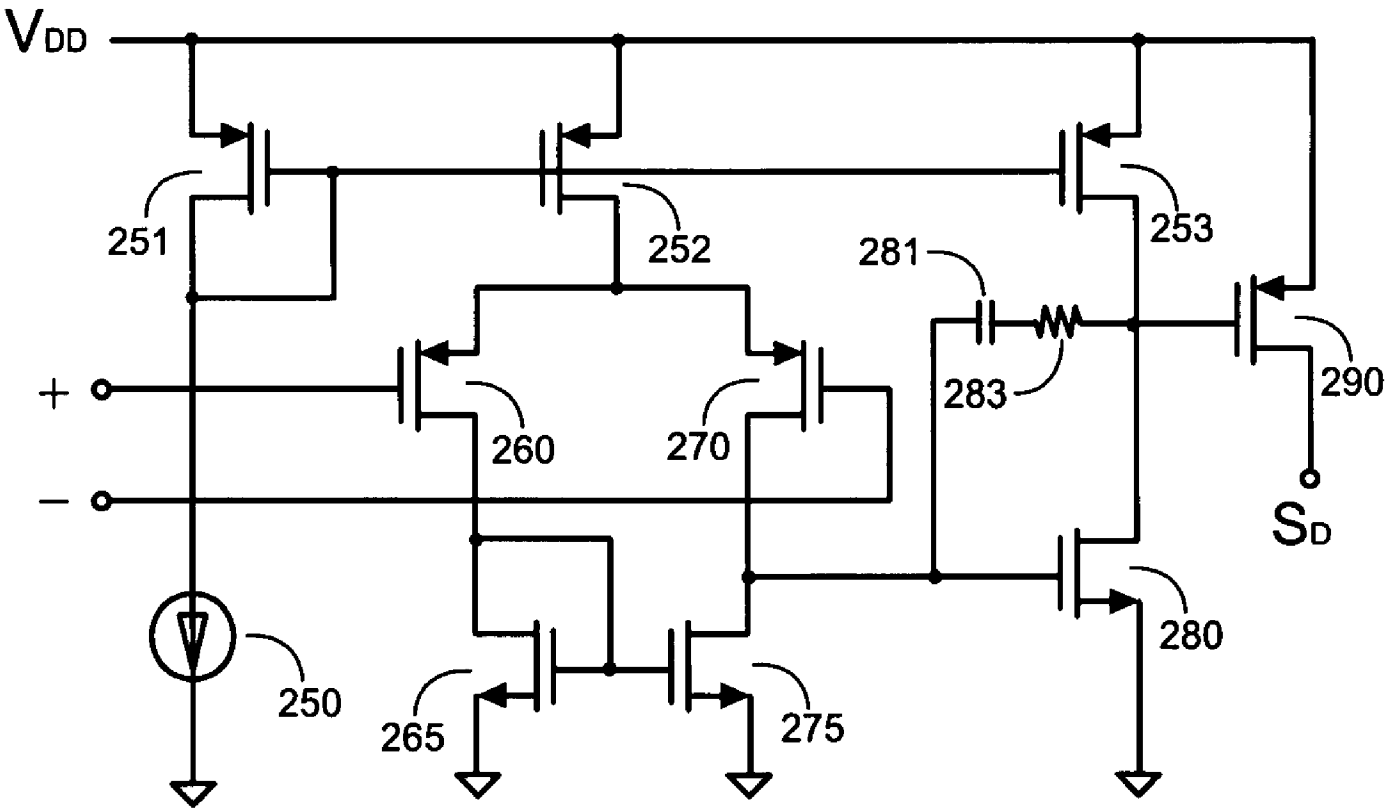
FIG. 11 shows a circuit diagram of another trans-conductance buffer amplifier according to the present invention.

FIG. 11 shows another example circuit for trans-conductance buffer amplifiers 150 and 160. The circuit comprises a plurality of transistors 251, 252, 253, 260, 265, 270, 275, 280, 290 and a current source 250, a capacitor 281 and a resistor 283 connected in series. The transistor 251 has a gate that is coupled to the transistors 252, 253 and the current source 250, a drain that is coupled to the current source 250, and a source that is coupled to the voltage source $V_{DD}$ and the transistors 252, 253, 290. The transistor 252 has a gate that is coupled to the transistor 251, a drain that is coupled to the transistors 260 and 270, and a source that is coupled to the voltage source $V_{DD}$ and the transistors 251, 253 and 290. The transistor 253 has a gate that is coupled to the transistor 251, a drain that is coupled to the resistor 283 the transistors 280, 290, and a source that is coupled to the voltage source $V_{DD}$ and the transistors 251, 252, 290. The transistor 260 has a gate that is coupled to a non-inverting input terminal of the amplifier, a drain that is coupled to the transistors 265 and 275, and a source that is coupled to the transistors 252, 270. The transistor 270 has a gate that is coupled to an inverting input terminal of the amplifier, a drain that is coupled to the transistors 275, 280 and the capacitor 281, and a source that is coupled to the transistor 252. The transistor 265 has a gate that is coupled to the transistors 275 and 260, a drain that is coupled to the transistor 260, and a source that is coupled to the ground. The transistor 275 has a gate that is coupled to the transistors 265 and 260, a drain that is coupled to the transistor 280 and the capacitor 281, and a source that is coupled to the ground. The transistor 280 has a gate that is coupled to the transistors 270, 275 and the capacitor 281, a drain that is coupled to the transistors 253, 290 and the resistor 283, a source that is coupled to the ground. The transistor 290 has a gate that is coupled to the transistors 280, 253 and the resistor 283, a source that is coupled to the voltage source $V_{DD}$ and the transistors 251, 252, 253, and a drain receives the feedback signal $S_D$.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A controller of LED driver to control a plurality of LEDs, comprising:

a plurality of current sources coupled to the LEDs to control a plurality of LED currents;

a detection circuit coupled to the LEDs and sensing a plurality of voltages of the current sources for generating a clamp signal in response to a maximum voltage of the current sources; and a buffer circuit generating a feedback signal in accordance with the clamp signal to control a maximum voltage across the current sources;

wherein the detection circuit comprising:

a sample-and-hold circuit, sensing the voltages of the current sources for generating current-source signals; and a plurality of amplifiers, receiving the current-source signals to generate the clamp signal;

wherein the amplifiers are connected in parallel, and the clamp signal is generated in response to a maximum voltage of the current-source signals.

2. The controller of claim 1, wherein the feedback signal is coupled to a switching circuit through an optical-coupler and the switching circuit generates the LED currents through a transformer.

3. The controller of claim 1, wherein the detection circuit has a threshold voltage compared with the voltages of the current sources to generate the clamp signal.

4. The controller of claim 1, wherein the sample-and-hold circuit comprising:

a plurality of voltage-clamp transistors coupled to the current sources for clamping the voltage of the current sources under a maximum value;

a plurality of sample-switches connected with the voltage-clamp transistors in series to sample the voltage of the current sources; and a plurality of hold-capacitors coupled to the sample-switches for generating current-source signals;

wherein a gate of voltage-clamp transistors has a threshold voltage.

5. An offline control circuit of LED driver to control a plurality of LEDs, comprising:

a voltage-feedback circuit coupled to the LEDs to sense a voltage-feedback signal correlated to a voltage across the LEDs for generating a voltage loop signal;

a plurality of current sources coupled to the LEDs to control a plurality of LED currents;

a detection circuit coupled to the LEDs and sensing a plurality of voltages of the current sources for generating a clamp signal in response to a maximum voltage of the current sources; and a buffer circuit generating a feedback signal in accordance with the voltage loop signal and the clamp signal to control a maximum voltage of the LEDs and a maximum voltage across the current sources;

wherein the detection circuit comprising:

a sample-and-hold circuit, sensing the voltages of the current sources for generating current-source signals; and a plurality of amplifiers, receiving the current-source signals to generate the clamp signal;

wherein the amplifiers are connected in parallel, and the clamp signal is generated in response to a maximum voltage of the current-source signals.

6. The offline control circuit of claim 5, wherein the feedback signal is coupled to a switching circuit through an optical-coupler, and the switching circuit generates the LED currents through a transformer.

7. The offline control circuit of claim 5, wherein the voltage-feedback circuit has a reference voltage compared with the voltage-feedback signal to generate the voltage loop signal.

8. The offline control circuit of claim 5, wherein the detection circuit has a threshold voltage compared with the voltages of the current sources to generate the clamp signal.

9. The offline control circuit of claim 5, further comprising a control terminal received a control signal, which for controlling intensity of the LEDs; wherein a control current is generated in response to the control signal, and the control current is transmitted to the voltage-feedback circuit to control the voltage across the LEDs.

10. The offline control circuit of claim 5, wherein the voltage-feedback circuit comprising:

a first operational amplifier, receiving the voltage-feedback signal for generating the voltage loop signal; and a first capacitor coupled from an output of the first operational amplifier to a ground for frequency compensation;

wherein the first operational amplifier is a trans-conductance operational amplifier.

11. The offline control circuit of claim 5, wherein the sample-and-hold circuit comprising:

a plurality of voltage-clamp transistors coupled to the current sources for clamping the voltage of the current sources under a maximum value;

a plurality of sample-switches connected with the voltage-clamp transistors in series to sample the voltage of the current sources; and a plurality of hold-capacitors coupled to the sample-switches for generating current-source signals;

wherein a gate of voltage-clamp transistors has a threshold voltage.

12. The offline control circuit of claim 5, wherein the buffer circuit comprises two buffer amplifiers connected in parallel and receives the voltage loop signal and the clamp signal respectively for generating the feedback signal.

* * * * *